United States Patent [19]

Aizawa et al.

[11] Patent Number: 5,047,998

[45] Date of Patent: Sep. 10, 1991

[54] TIMEPIECE WITH MOBILE DECORATIONS

[75] Inventors: Junichi Aizawa; Shoichiro Kumazawa; Tomohiro Wada, all of Tokyo, Japan

[73] Assignee: Seikosha Co., Ltd., Japan

[21] Appl. No.: 387,625

[22] Filed: Jul. 31, 1989

[30] Foreign Application Priority Data

Jul. 29, 1988 [JP] Japan ..... 63-189863

[51] Int. Cl.[5] ..... G04B 21/02; G04B 19/06; G04C 23/00

[52] U.S. Cl. ..... 368/75; 368/229; 368/272; 368/285

[58] Field of Search ..... 368/10, 45, 75, 76, 368/223, 243, 244, 250, 251, 269–273, 276, 278; 84/3, 4, 94.1

[56] References Cited

U.S. PATENT DOCUMENTS 1,373,176 3/1921 Dittrich ..... 368/274
4,098,068 7/1978 Masuyama ..... 368/272

FOREIGN PATENT DOCUMENTS 1909223 9/1970 Fed. Rep. of Germany ..... 368/272

*Primary Examiner*—Vit W. Miska
*Attorney, Agent, or Firm*—Bruce L. Adams; Van C. Wilks

[57] ABSTRACT

A timepiece with mobile decorations comprises: a roof disposed over a case body having a timepiece unit built therein; driving means to make said roof up and down while turning the same in response to a signal from the said timepiece unit; and mobile decorations disposed inside of the roof to operate and become visible from the outside while the roof is in a raised position.

20 Claims, 5 Drawing Sheets

TIMEPIECE WITH MOBILE DECORATIONS

BACKGROUND OF THE INVENTION

The present invention relates to a timepiece with mobile decorations.

In the prior art, the so-called "Karakuri" or puppet clock, in which puppets dance at the hour, is well known and has a variety of structures.

The puppet clock of the prior art has a complicated structure and is expensive so that it is hard to buy personally. Despite of this problem, however, the "Karakuri" have a deep-rooted popularity. Especially in recent years, a demand for joyful or surprising clocks is increasing.

An object of the present invention is to meet the demand and to provide at a reasonable price a clock having mobile decorations which can perform joyful motions at the hour.

In order to achieve the above-specified object, the timepiece with mobile decorations according to the present invention comprises: a roof disposed over a case body having a timepiece unit built therein; driving means to make said roof up and down while turning the same in response to a signal from the said timepiece unit; and mobile decorations disposed inside of the roof to operate and become visible from the outside while the roof is in a raised position.

The driving means of the roof may include a motor adapted to operate in response to the signal; a cylindrical member adapted to be rotationally driven by the motor and supported rotatably on the case body; a lead screw fitted so as to be nonrotatable but axially slidable relative to said cylindrical member and having its upper end portion connected to the roof; and a protrusion disposed in a fixed relation to the case body and meshing with the lead screw.

DETAILED DESCRIPTION OF THE DRAWINGS

In the drawing showing one embodiment of the present invention:

DESCRIPTION OF PREFERRED EMBODIMENT

One embodiment of the present invention will be described in the following with reference to the accompanying drawings.

Figure 1:
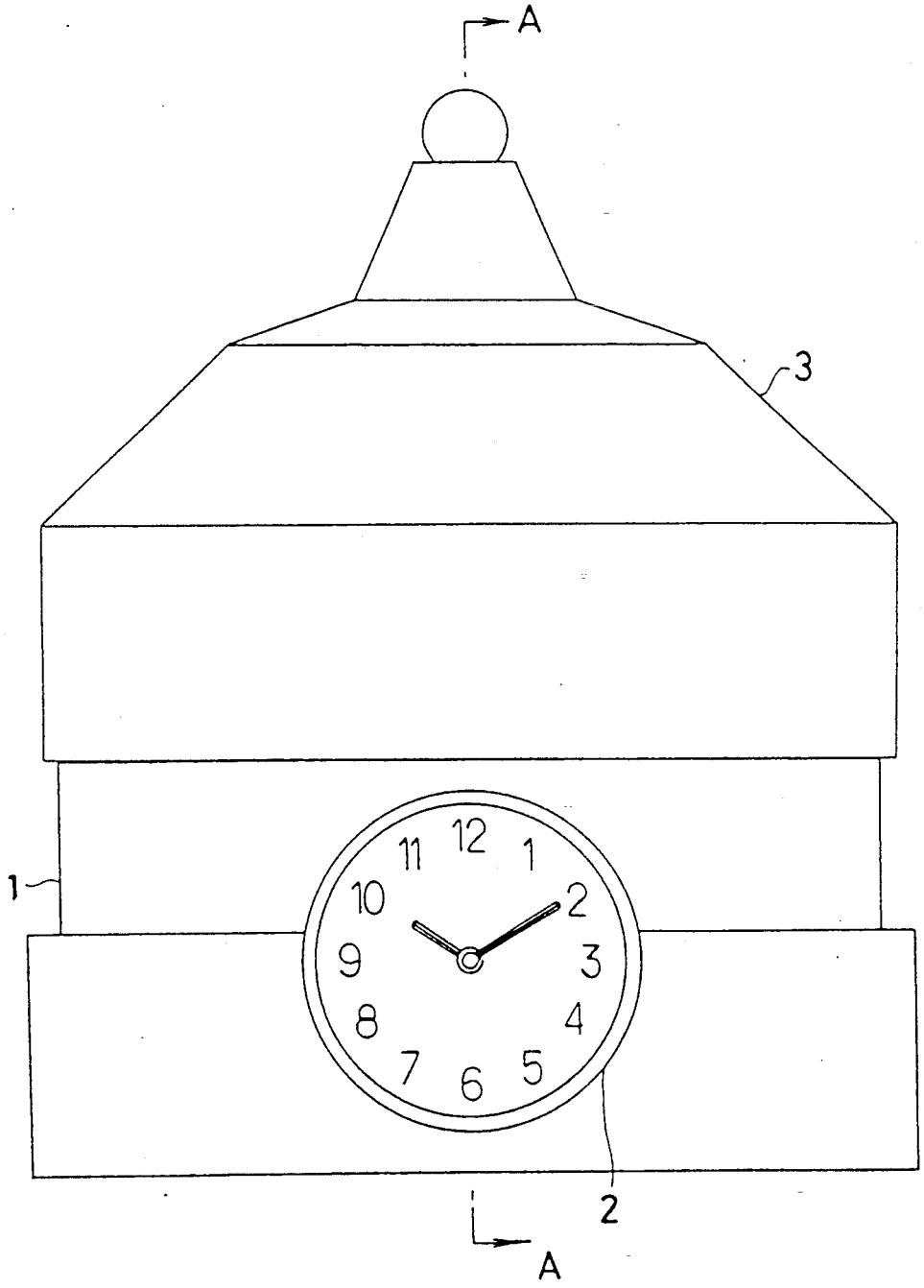
FIG. 1 is a front elevation.

As shown in FIG. 1, a timepiece unit 2 is built in the front of a case body 1. Over this case body 1, a roof 3 is disposed This roof 3 is provided to cover mobile decorations 4, while it is in a lowered position, as shown in FIG. 1, to make them invisible from the outside. The roof 3 exposes the mobile decorations 4 to the outside, while it is in a raised position, to make them visible from the outside. The roof 3 can be moved up and down, while turning, between those two positions.

Driving means 5 for turning and moving the roof 3 up and down will be described in hereinbelow.

Figure 2:
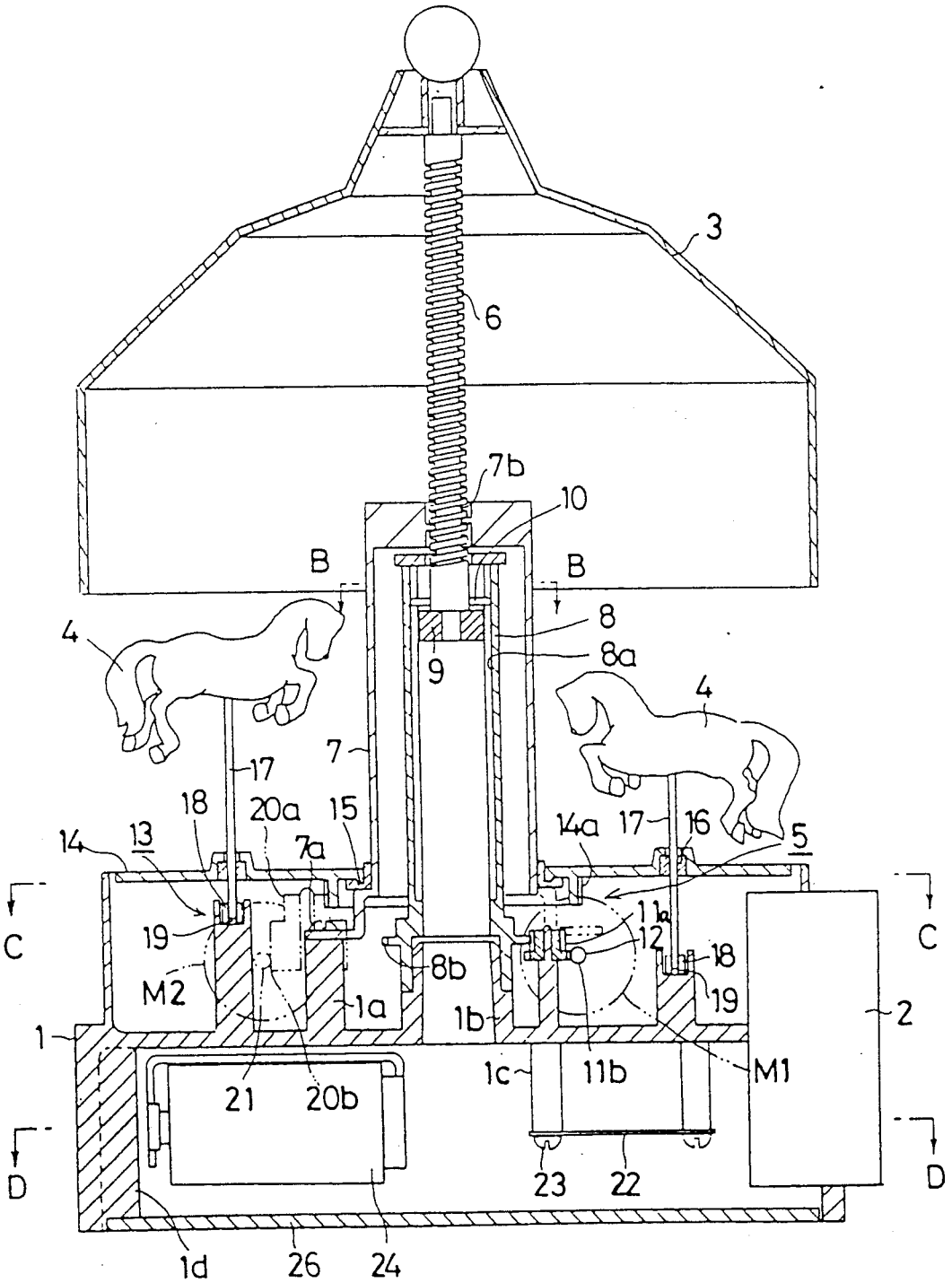
FIG. 2 is a section taken along the line A—A of FIG. 1 in the operating state.
Figure 3:
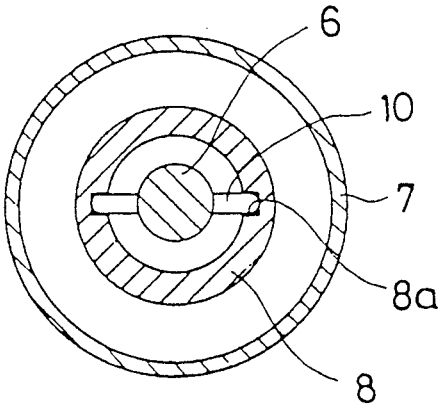
FIG. 3 is an enlarged section taken along the line B—B of FIG. 2.

As better seen from FIG. 2, the roof 3 is fixed on the upper end portion of a lead screw 6. To an install stud 1*a* of the case body 1, there is fixed by means of screws 7*a* a cylindrical support member 7 which is formed with a hole having a protrusion 7*b* which is in meshing engagement with the lead screw 6. This lead screw 6 extends through that hole while meshing with the protrusion 7*b*. To the lower end portion of the lead screw 6, there is fixed a slider 9 which can slide in the axial direction on the inner circumference of a cylindrical member 8. A pin 10 extends radially through the upper portion of the slider 9 with its two ends protruding. The two end protrusions of the pin 10 are fitted in axial grooves 8*a*, which are formed in the inner circumference of the cylindrical member 8, as better seen in FIG. 3, so that the lead screw 6 is made nonrotatable relative to the cylindrical member 8. This cylindrical member 8 is rotatably supported by a support member 1*b* of the case body 1 and is equipped with a driving gear 8*b*.

Figure 4:
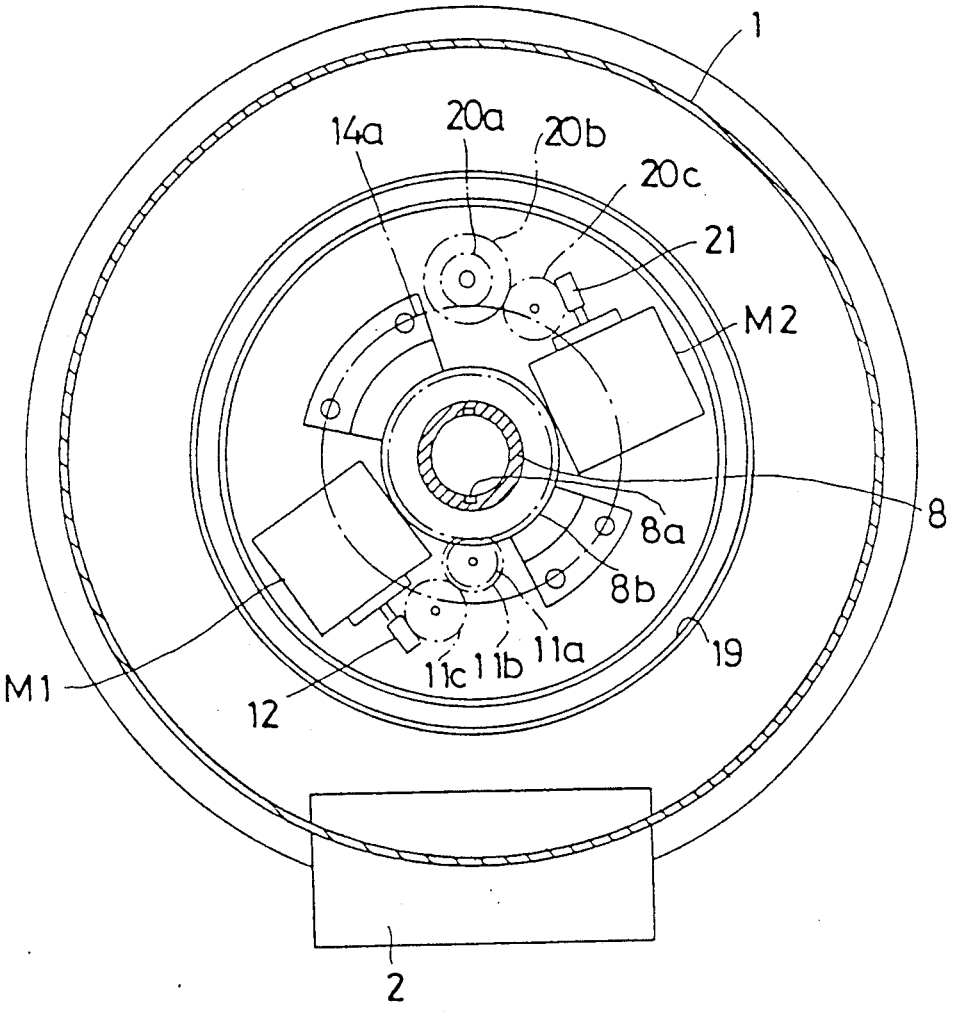
FIG. 4 is a section taken along the line C—C of FIG. 2.

The cylindrical member 8 is rotationally driven by a motor M1 which operates in response to a signal produced by the timepiece unit 2. As shown in FIG. 4, specifically, a worm gear 11*b* meshes through a transmission wheel 11*c* with a worm 12, which is mounted on the spindle of the motor M1, and the driving gear 8*b* meshes with a pinion 11*a* integral with the worm gear 11*b*, thus turning the cylindrical member 8.

Next, driving means 13 for the mobile decorations 4 will be described in the following.

As shown in FIG. 2, a turn disk 14 is rotatably supported through a bushing 15 by the support member 7 and is formed with a driving gear 14*a* at its lower face. The turn disk 14 is equipped with a plurality of shafts 17 which extend vertically and slidably through bushings 16, and the mobile decorations 4 are fixed to the upper end portions of the shafts 17. To the lower end portions of the shafts 17, there are turnably connected rollers 18 which are movable while turning on a cam 19 which is formed in the case body 1. The cam 19 has a circular shape, as seen in a top plan view in FIG. 4, and has an undulation of a wave form.

The turn disk 14 is rotationally driven by a motor M2 which operates in response to the signal produced by the timepiece unit 2. More specifically, a worm gear 20*b* meshes through a transmission wheel 20*c* with a worm 21 which is mounted on the spindle of the motor M2, and the driving gear 14*a* meshes with a pinion 20*a* integral with the worm gear 20*b*, thus turning the turn disk 14.

Figure 5:
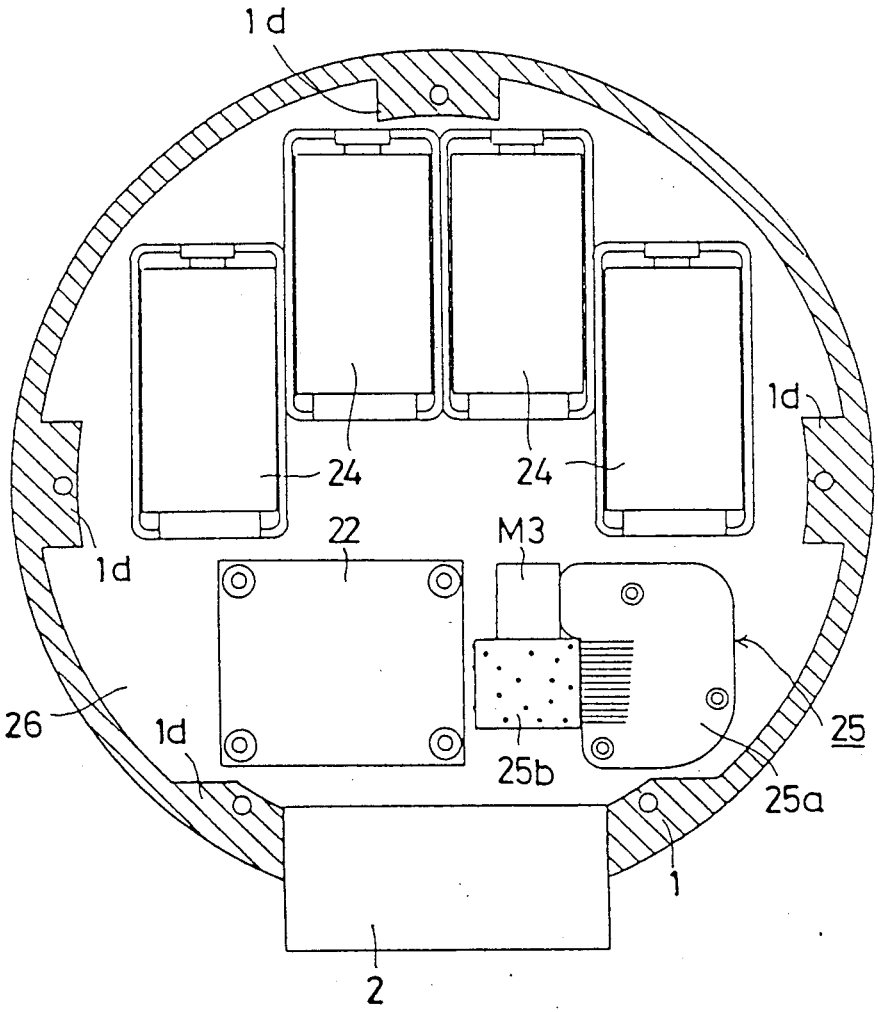
FIG. 5 is a section taken along the line D—D of FIG. 2.

As shown in FIG. 5, reference numeral 22 designates a printed circuit board which provides a control circuit not-shown and which is installed on install studs 1*c* of the case body 1 by means of screws 23. Numeral 24 designates a battery for providing a driving source of the motors M1 and M2 and the timepiece unit 2. Numeral 25 designates a music box which is equipped with a vibration leaf 25*a* and a drum 25*b*. This drum 25*b* is rotationally driven by a motor M3 which operates in response to the signal produced by the timepiece unit 2. A bottom lid 26 is fixed to a mounting portion 1*d* of the case body 1 by means of screws.

When the motors M1 and M3 operate in response to the signal produced by the timepiece unit 2, e.g., the signal of the hour, the worm 12 of the spindle of the motor M1 is rotated so that these rotations are transmitted sequentially to the transmission wheel 11*c*, the worm gear 11*b*, the pinion 11*a* and the driving wheel 8*b* to turn the cylindrical member 8. Then, the cylindrical member 8 turns the lead screw 6 and the roof 3. Since the stationary protrusion 7*b* meshes with the lead screw 6, the lead screw 6 gradually raises, as it is turned. to raise the roof 3. At the same time, moreover, a melody is played by the music box 25 by the operation of the motor M3.

When the roof 3 is raised to allow the mobile decorations 4 to be seen below its lower end portion from the outside, the signal is fed to the motor M2 to rotate the worm 21 of the motor spindle. The rotations are transmitted sequentially to the transmission wheel 20*c*, the worm gear 20*b*, the pinion 20*a* and the driving gear 14*a* to turn the turn disk 14. As the turn disk 14 is turned, the mobile decorations 4 are also turned. At this time, the rollers 18 turn on the undulating cam 19 to move the shafts 17 up and down so that the mobile decorations 4 are turned while being moved up and down. In this meanwhile, the play of the melody is continued by the music box 25.

After a predetermined time has elapsed, a reverse signal is fed to the motor M1. As a result, the lead screw 6 is rotated in the opposite direction to the aforementioned one so that the roof 3 is gradually lowered while being rotated backward. When the roof 3 is lowered up its lowermost position, the application of the signal to the motors M2 and M3 is interrupted. When the roof 3 is returned to the original position shown in FIG. 1 to cover the mobile decorations 4, the operation of the motor M1 is interrupted.

Incidentally, the mobile decorations 4 are exemplified by a merry-go-round but should not be limited thereto. For example, puppets can be easily constructed to revolve on their axes and around the lead screw. It is also possible to provide a variety of mobile decorations.

According to the present invention described in the above, it is possible to provide at a reasonable price and in a simple structure a timepiece having mobile decorations which are enabled to perform joyful motions at the correct hour. Thus, the present invention can meet the demand of users for joyful and surprising clocks.

We claim:

1. A timepiece with mobile decorations comprising: a roof disposed over a case body having a timepiece unit built therein; driving means for driving said roof between raised and lowered positions while turning the same in response to a signal from the said timepiece unit; and mobile decorations disposed inside of said roof when said roof is in the lowered position to operate and become visible from the outside when said roof is in the raised position.

2. A timepiece as set forth in claim 1, wherein said driving means includes a motor operative in response to said signal; a cylindrical member connected to be rotationally driven by said motor and supported rotatably on said case body; a lead screw fitted so as to be nonrotatable but axially slidable relative to said cylindrical member and having an upper end portion connected to said roof; and a protrusion disposed in a fixed relation to said case body and meshing with said lead screw.

3. A timepiece with mobile decorations comprising:

a case body;

a plurality of mobile decorations mounted on the case body to undergo movement;

covering means movable between a first position and a second position for covering the mobile decorations when in the first position and for uncovering the mobile decorations when in the second position;

timekeeping means disposed on the case body for keeping time and for generating timing signals; and driving means responsive to the timing signals from the timekeeping means for driving the covering means between the first and second positions and for moving the mobile decorations when the covering means reaches the second position.

4. A device according to claim 3, wherein the timekeeping means comprises means for generating first and second timing signals; and the driving means comprises first driving means responsive to the first timing signal for driving the covering means and second driving means responsive to the second timing signal for moving the plurality of mobile decorations.

5. A device according to claim 4, wherein the second driving means comprises means for moving the mobile decorations up and down.

6. A device according to claim 4, wherein the second driving means comprises means for rotating the mobile decorations.

7. A device according to claim 4, wherein the second driving means comprises means for moving the mobile decorations up and down and for rotating the mobile decorations.

8. A device according to claim 4, wherein the first driving means comprises a motor responsive to the first timing signal, a rotatable cylindrical member rotatably driven by the motor and supported rotatably on the case body, and a lead screw fitted in the cylindrical member and connected so as to be nonrotatable and axially slidable relative to the cylindrical member, the lead screw being connected at one end to the covering means.

9. A device according to claim 4, wherein the first driving means comprises means for driving the covering means between lowered and raised vertical positions.

10. A device according to claim 3, wherein the mobile decorations comprise a decorative merry-go-round.

11. A device according to claim 3, further comprising sound emitting means for emitting an audible sound when the covering means reaches the second position.

12. A device according to claim 3, wherein the covering means comprises a decorative roof.

13. A timepiece with mobile decorations that emits an audible sound comprising:

a case body;

a plurality of mobile decorations mounted on the case body to undergo movement;

covering means movable between a first position and a second position for covering the mobile decorations when in the first position and for uncovering the mobile decorations when in the second position;

controllable sound emitting means for emitting an audible sound;

timekeeping means disposed on the case body for keeping time and for generating timing signals; and driving means responsive to the timing signals from the timekeeping means for driving the covering means between the first and second positions and for moving the mobile decorations when the covering means reaches the second position and for controlling the sound emitting means.

14. A device according to claim 3, wherein the timekeeping means comprises means for generating first, second and third timing signals; and the driving means comprises first driving means responsive to the first timing signal for driving the covering means, second driving means responsive to the second timing signal for moving the plurality of mobile decorations and controlling means responsive to the third timing signal for controlling the sound emitting means.

15. A device according to claim 14, wherein the controlling means includes means for controlling the sound emitting means so that an audible sound is emitted as the covering means moves to the second position.

16. A device according to claim 14, wherein the second driving means comprises means for moving the mobile decorations up and down and for rotating the mobile decorations.

17. A device according to claim 14, wherein the first driving means comprises means for driving the covering means between lowered and raised vertical positions.

18. A device according to claim 13, wherein the sound emitting means comprises a music box for emitting musical sounds.

19. A device according to claim 13, wherein the mobile decorations comprises a decorative merry-go-round.

20. A device according to claim 13, wherein the covering means comprises a decorative roof.

* * * * *